US006920718B2

(12) United States Patent
Hom et al.

(10) Patent No.: US 6,920,718 B2
(45) Date of Patent: Jul. 26, 2005

(54) INDEPENDENT BACKUP POWER SUPPLY FOR A SECURITY BARRIER

(75) Inventors: Wayne C. Hom, Rancho Santa Margarita, CA (US); Walter Parsadayan, Lake Forest, CA (US); Daniel Perez, Foothill Ranch, CA (US)

(73) Assignee: The Chamberlain Group, Inc., Elmhurst, IL (US)

( * ) Notice: Subject to any disclaimer, the term of this patent is extended or adjusted under 35 U.S.C. 154(b) by 0 days.

(21) Appl. No.: 10/407,315

(22) Filed: Apr. 3, 2003

(65) Prior Publication Data

US 2004/0194387 A1 Oct. 7, 2004

(51) Int. Cl.[7] ..... E01F 13/00
(52) U.S. Cl. ..... 49/49; 307/66
(58) Field of Search ..... 49/31, 49; 307/18–29, 307/43–48, 64, 66, 80

(56) References Cited

U.S. PATENT DOCUMENTS 3,950,686 A * 4/1976 Randall ..... 318/564
4,423,364 A * 12/1983 Kompelien et al. ..... 318/440
4,490,624 A 12/1984 Luker
4,630,395 A * 12/1986 Nasatka ..... 49/49
4,711,608 A * 12/1987 Ghusn ..... 404/6
4,904,880 A * 2/1990 Yoshida ..... 307/66
5,144,153 A * 9/1992 Scheppmann, II ..... 307/66
6,847,130 B1 * 1/2005 Belehradek et al. ..... 307/66
2003/0029089 A1 * 2/2003 Wenzl et al. ..... 49/49
2003/0052627 A1 * 3/2003 Raimondi ..... 318/107

* cited by examiner

*Primary Examiner*—Jerry Redman
(74) *Attorney, Agent, or Firm*—Fitch, Even, Tabin & Flannery

(57) ABSTRACT

A system is disclosed for providing a backup power supply for a security gate system. In a preferred embodiment it includes a primary power supply, an AC motor and an auxiliary DC motor that share the same accessory devices including controller, movement mechanism, sensors, communication unit, etc. The auxiliary DC motor has its own independent DC power supply. If the primary power supply fails the auxiliary power supply takes over and moves the barrier between the open and closed positions as needed without interruption of service.

11 Claims, 5 Drawing Sheets

INDEPENDENT BACKUP POWER SUPPLY FOR A SECURITY BARRIER

FIELD OF THE INVENTION

The present invention relates to security barrier systems that use motors to open and close the barriers and more particularly to a system that includes a backup power supply.

BACKGROUND OF THE INVENTION

Security systems that control access to a secure area are quite common. Gated communities, apartment complexes, office complexes and manufacturing facilities are among those that use such security systems to limit and control access. These security systems usually include one or more barriers, doors or gates that limit access into the protected limited access area. Theses systems typically include a mechanism to open and close the barrier that is driven by a motor. Generally, these motors are electrical and receive their power from the local power grid. In the event of a failure of the motor to function properly due to a malfunctioning of the motor or loss of electrical power from the local power grid, often the only alternative is to disconnect the barrier from the drive mechanism that connects it to the motor and open and close the barrier manually. Another alternative is to manually crank the barrier open or closed with a crank handle that inserts into a crank receptacle located on the motor drive shaft or some other shaft or pulley of the barrier movement mechanism.

Having to disconnect the barrier from the drive mechanism and manually open or close the barrier defeats the whole purpose for the security system, which is to provide an efficient and cost effective way to control access to the secure area. Correction of the problem may require service by a trained technician. Consequently, the barrier may not properly function for several hours to several days depending on how soon a properly trained service technician can be dispatched to the site of the malfunctioning barrier.

There are backup systems such as the DC1000 produced by Elite Access Systems and others, but they require separate input and output devices such as limit switches, loop detectors, safety sensors, alarm output devices, and other essential devices that must be duplicated separately and apart from the existing primary control system.

An additional problem with all existing backup systems is that they entail a breach of the security provided by the security system in order to have them function. In some cases it is even worse; the system ceases to function until it is repaired.

Thus, what is needed is a system and method for providing for opening and closing a security barrier without the need to provide redundant devices in order to maintain the integrity and safe operation of the system when the primary motive or power for the system stops functioning due a loss of electrical power or malfunctions for some other reason. Such a system would have to provide for a quick and efficient transfer from the nonfunctioning primary power source and motive force to a secondary power source and motive source.

SUMMARY

It is an objective of the present invention to provide a backup power supply and backup motive source to allow a movable security barrier to continue operation in an uninterrupted fashion if the primary power supply or motive force shall fail. It is a further objective to provide a backup power supply and motive source that do not require redundant accessory systems but that can use the same accessory systems.

The present invention accomplishes these and other objectives by providing a security barrier system with alternate power source, the system including: a) a security barrier movable between and open and a closed position; b) a mechanical apparatus for moving the barrier when the mechanical apparatus is engaged by an appropriate motive force; c) a primary motive source for engaging the mechanical apparatus to thereby move the barrier between an open and a closed position; d) a primary power supply to power operation of the primary motive source; e) a barrier controller operatively connected to the primary motive force to thereby control the movement of the barrier by controlling operations of the primary motive source; f) a secondary motive source operatively connected to the barrier controller and the secondary motive source being capable of engaging the mechanical apparatus; g) a secondary power supply to power operation of the secondary motive source; h) a sensor connected to the system for sensing failure of the primary power supply or motive force; and i) an activation device connected to the system, which upon receipt of a signal from the sensor indicating a failure of the primary power supply or the primary motive force activates operation of the secondary power supply and the secondary motive force, so that the controller can continue to control movement of the barrier without interruption.

In an additional aspect of one preferred embodiment the system of the present invention the primary motive source is an AC motor, the primary power supply is an AC power supply, the secondary motive force is a DC motor, the secondary power supply is a DC power supply.

In yet another aspect of the present invention the barrier controller, the sensor and the activation device all function on DC power and further including a converter to convert AC power from the primary power supply to DC power to power operation of the barrier controller, the sensor and the activation device and wherein when the primary power supply fails the barrier controller, the sensor and the activation device all receive power from the DC power supply.

In another variation of the present invention it can function with a sliding gate, a swinging gate, an overhead gate or a barrier gate.

BRIEF DESCRIPTION OF THE DRAWINGS

The invention will be better understood by an examination of the following description, together with the accompanying drawings, in which.

DETAILED DESCRIPTION OF THE PREFERRED EMBODIMENT

The system and apparatus of the present invention would function as part of an overall security system that includes one or more barriers or security gates that limit access to a secure area. The actual opening or closing of the gate may be controlled by a guard located adjacent to the gate. Alternatively, access may be controlled by various automated systems in which a person arriving at the gate must input into a keypad an appropriate authorization code to open the gate. In another variation the person may have a transponder that sends a coded signal in response to a signal from a transceiver attached to the gate controller in a standard fashion. Upon receiving and decoding the signal from the transponder the gate controller would open the barrier or gate and allow access if the code received and decoded was an authorized one. The system may also include a phone located adjacent to the gate on which a person seeking entry can call a person or unit within the secure area with the authority to allow access by sending a gate open signal to the gate controller.

Figure 1:
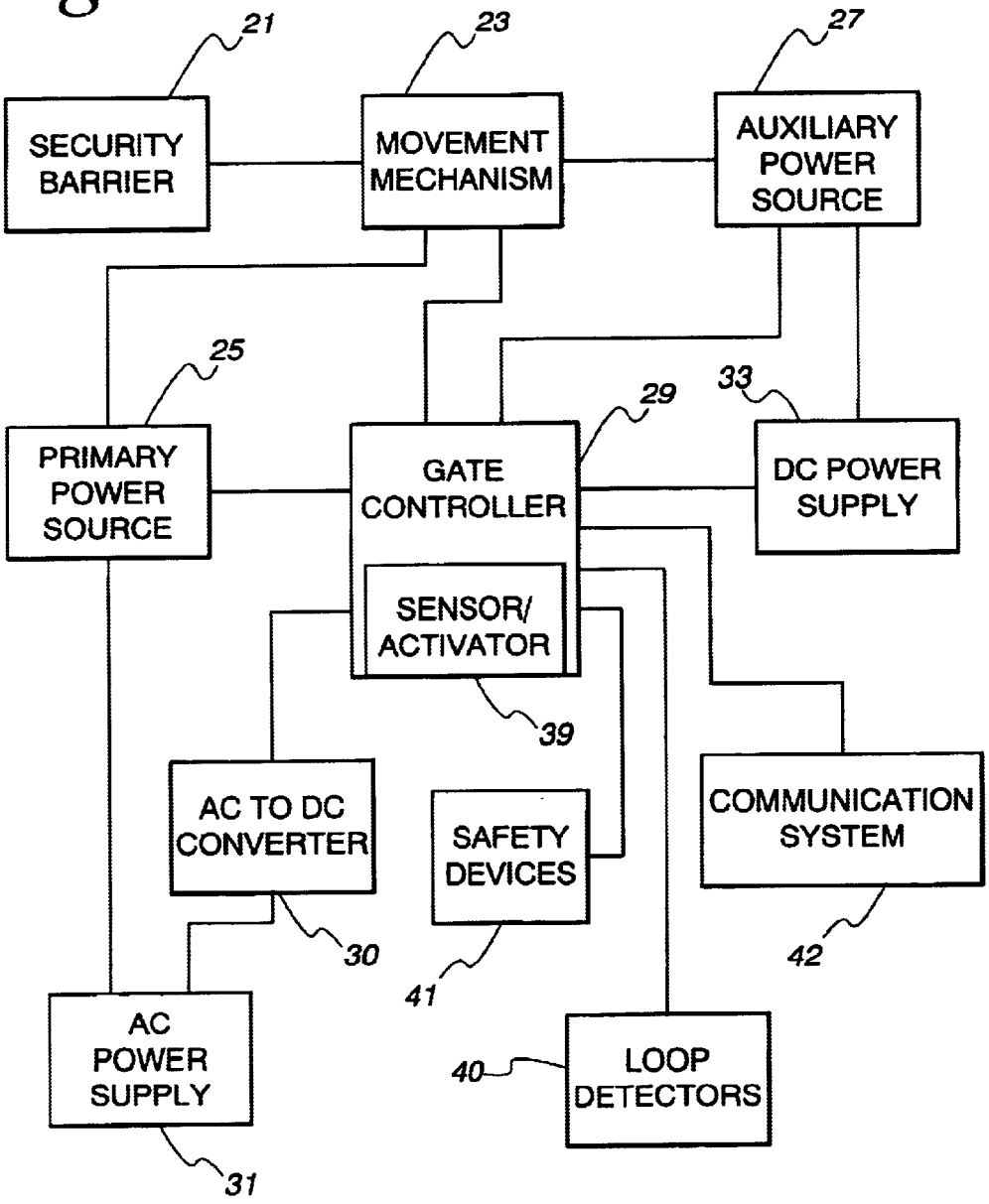
FIG. 1 is block diagram of the major functional components of the system of the present invention.

The system and apparatus of the present invention includes the functional components depicted in FIG. 1, a block diagram. The system includes a movable security barrier 21, a movement mechanism 23, such as a gear system a primary motive or movement source 25, such as an AC motor a secondary or auxiliary motive or movement source 27, a DC motor, a gate controller 29, an AC current source 31, and a DC current source 33. A sensor/activator 39, monitors operation of the system, in particular the AC power supply 31 and AC motor 25 and upon detecting a failure in either to operate, switches the system over to operation using the DC power supply 33 and auxiliary DC motor 27.

Security gate systems as noted above typically also include communication systems 42 to allow for communication with persons within the secure area or direct communication with the gate controller to initiate opening of the gate or barrier 21. This might be done by communication between a transponder in a vehicle seeking entry, not shown and a transponder in communication system 42. The transponder in the vehicle sends a security code to the transponder in communication system 42, which in turn signals the gate controller 29 to open the gate by using the AC motor 25. Additionally, the system will have various safety devices 41, and loop detectors 40. Loop detectors 40 are placed on either side of the entry where the gate 21 is located, and provide the system with information on whether or not any vehicles are present in the area of gate 21. Loop detectors 40 allow the gate controller or operator 29 to determine when it can safely open or close gate 21.

In the preferred embodiment, gate controller 29 is a dedicated electronic system with a control board, and all of the peripheral devices necessary for it to function properly. Additionally, in the preferred embodiment gate controller 29 operates on DC power, which is supplied by the AC power supply, i.e. local public power transmission grid, . Naturally, the system includes an AC to DC converter to provide the appropriate DC current. If the system has to switch over to operation on DC power it can operate directly off DC power supply 33. Additionally, in the Preferred embodiment the other subsystems, i.e.; loop detectors 40, safety devices and communication system 42 operate on DC current so they can operate off of the AC power supply with appropriate conversion to DC current or directly off of the DC power supply 33

Security barrier 21 is a typical security gate, garage door or other similar barrier that is opened and closed on a selective basis to allow or deny access to those seeking entry into the secure area. Movement mechanism 23 would move barrier 21 between an open and a closed position. Movement mechanism 23 would in a preferred embodiment include a gearbox for translating the motive force to move barrier 21. Movement mechanism 23 during standard operation would be driven by primary motive source 25, an AC electric motor in the preferred embodiment; motor 25 would typically receive its electrical power from AC power source 31, generally, the local public utility transmission grid. The system of the present invention also has a backup motive force, a DC motor 27 that receives its electrical power from an independent DC power supply 33 located adjacent to motor 27.

Additionally AC to DC converter 30 converts the AC power received from power source 31 to DC power to run gate controller 29, sensor activator 39, safety devices 41, loop detectors 40, and the communications system 42. AC power supply 31 also supplies main movement mechanism 23, which in the preferred embodiment, is an AC motor. Thus, as is noted, elsewhere aside from the movement mechanism 23 the rest of the parts of the system run on DC power.

Gate controller 29 monitors the system and controls the over all operation of the system. As noted above, sensor/activator 39 monitors operation of AC motor 25 and AC power supply 31. When sensory activator 39 detects a failure in the AC power supply 31 or AC motor 25 it will immediately switch the system over to operation with DC power supply 33 and DC motor 27.

One of the distinct advantages of the system of the present invention is the fact that there are no redundant systems except for the two motive sources, AC motor 25 and DC motor 27. Whether the system is operating on AC power and using the AC motor 25 to open and close barrier 21 or it is operating off of the DC Power 33 using DC motor 27 to open and close barrier 21, all of the other systems depicted in FIG. 1 and described above are the same. Additionally, the system is designed such that it can operate for an extended period of time on DC power 33 and, with the DC motor 27. As noted above the typical security gate system, if it has a backup DC motor for opening and closing the security gate, can only provide limited use, sometimes just opening the gate and no more, or require separate redundant systems, such as separate gate controller unit, etcetera.

Figure 2:
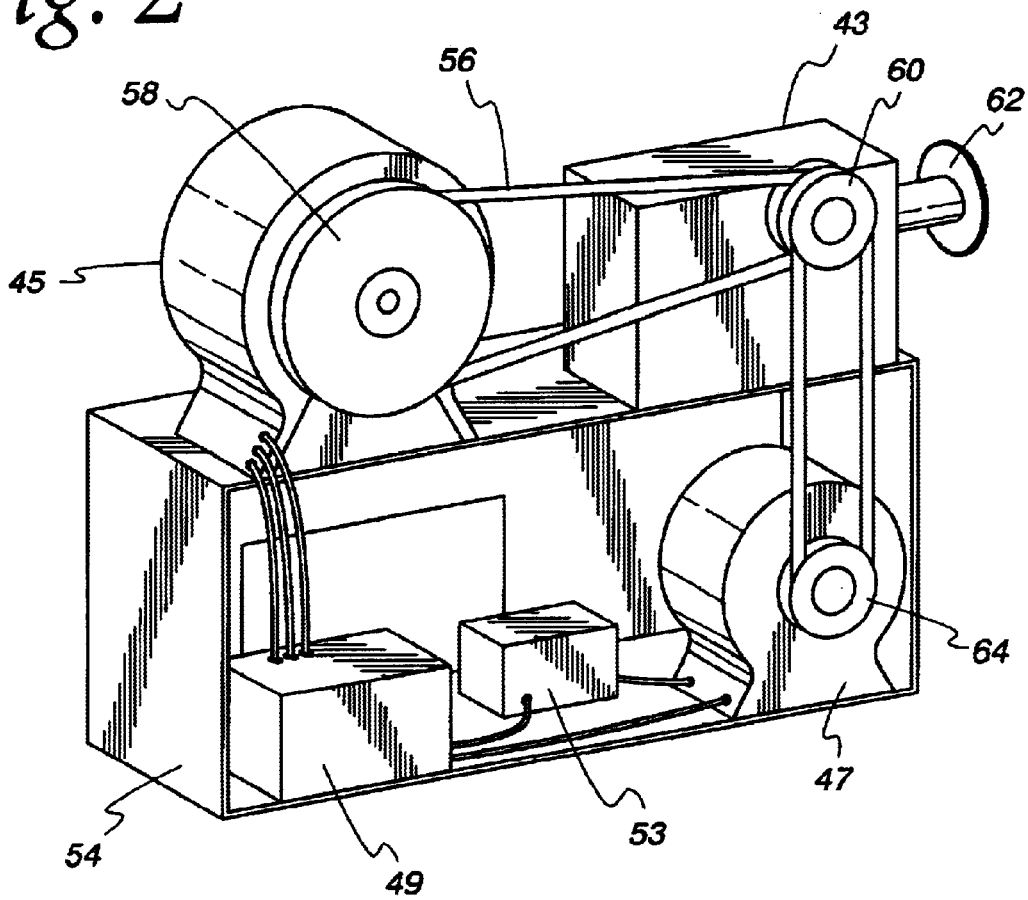
FIG. 2 is a raised perspective view of the primary and secondary power source and their connection to a portion of a sliding barrier movement mechanism.

FIG. 2 provides a perspective view of the major functional components of the present invention, configuration for a sliding gate, which include primary AC motor 45, movement mechanism 43 a gear box, DC motor 47, DC power supply 53 and gate controller 49. All of these components are housed in frame 54.

A noted above AC motor 45 obtains it electrical power from the local power grid, not shown. AC motor 45 provides the primary motive power for moving the gate or barrier between the open and closed position and visa versa. In the preferred embodiment depicted in FIG. 2 belt 56 transfers rotational motion from pulley 58 of motor 45 to input pulley 60 of gear box 43. In turn gear box 43 transfers that rotary motion to output pulley 62 that attaches to a chain, depicted in FIG. 3, that moves the barrier between the open and closed position. Gearbox 43 has appropriate gearing ratios within it to move the gate at an appropriate speed. Belt 57 connects to pulley 64 of DC motor 47 to pulley 60 of gearbox 43.

During normal operation when AC motor 45 is providing the power to open and close the gate, DC motor 47 is not in operation and is not receiving DC power from DC power source 53. DC power source 53 in the preferred embodiment is a rechargeable battery. In one version of the present invention DC motor 47 as it is being moved by belt 57 during operation of AC motor 45 charges DC battery 53. As noted, in part above, gate controller 49 includes a CPU with memory appropriate software and related relays and other devices for monitoring and controlling the operation of AC motor 45 and DC motor 47. As noted above gate controller 49 operates with DC power whether it is provided by the AC power source through an AC to DC current converter or it obtains DC current directly from the DC power supply. Thus, if controller 49 receives a signal to open the gate and AC motor 45 does not respond due to a loss of AC power or AC motor 45 malfunctions for some reason the sensor/activator 39 activates DC motor 47 which in turn moves belt 57 to turn pulley 60 of gear box 43 and thus open or close the gate as the case may be. The system thus can continue to operate in an uninterrupted fashion without any downtime or delay in opening or closing of the security gate. The system of the present invention maintains the integrity of the security system in allowing it to continue to function in an uninterrupted fashion. This arrangement eliminates the need for redundant movement mechanisms for each power supply since both motors share the same apparatus for transferring power for movement of the barrier.

In the preferred embodiment of a sensor/activator, the device is a micro-controller system consisting of a voltage monitor sensing the output of the AC converter. The voltage monitor consists of a resistive divider whose output is digitized through an analog to digital converter. The analog to digital converter can be a separate device or integrated with the micro-controller itself. Upon sensing a loss of power from the AC converter, the micro-controller switches the motor drive commands form the AC motor 45 to DC motor 47 and switches the power supply from the AC power source to the DC power source 53. Alternatively, the sensor/activator could be comprised of discrete logic to accomplish the switching functions.

Figure 3:
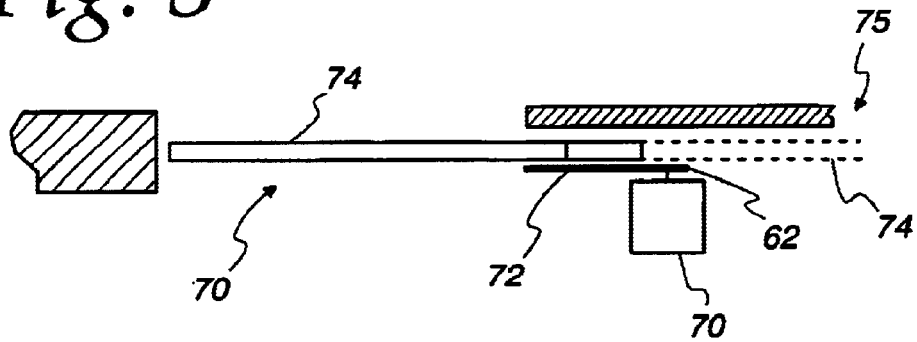
FIG. 3 is a top view of a sliding gate security system that might employee the apparatus depicted in FIG. 2.

The apparatus depicted in FIG. 2 is designed to move a sliding barrier as depicted in FIG. 3. In FIG. 3 the entire apparatus depicted in FIG. 2 is enclosed in exterior housing 70 with only output pulley 62 projecting outside of exterior housing 70. Pulley 62 is connected to chain 72 that in turn attaches to gate 74 and when pulley 62 turns it either moves gate 74 by movement of chain 72 from an open position 75, shown in outline, to a closed position 76 and visa versa. Naturally, as explained above the system can do this with power provided by either AC motor 45 or DC motor 47 depending on the circumstances.

Figure 4:
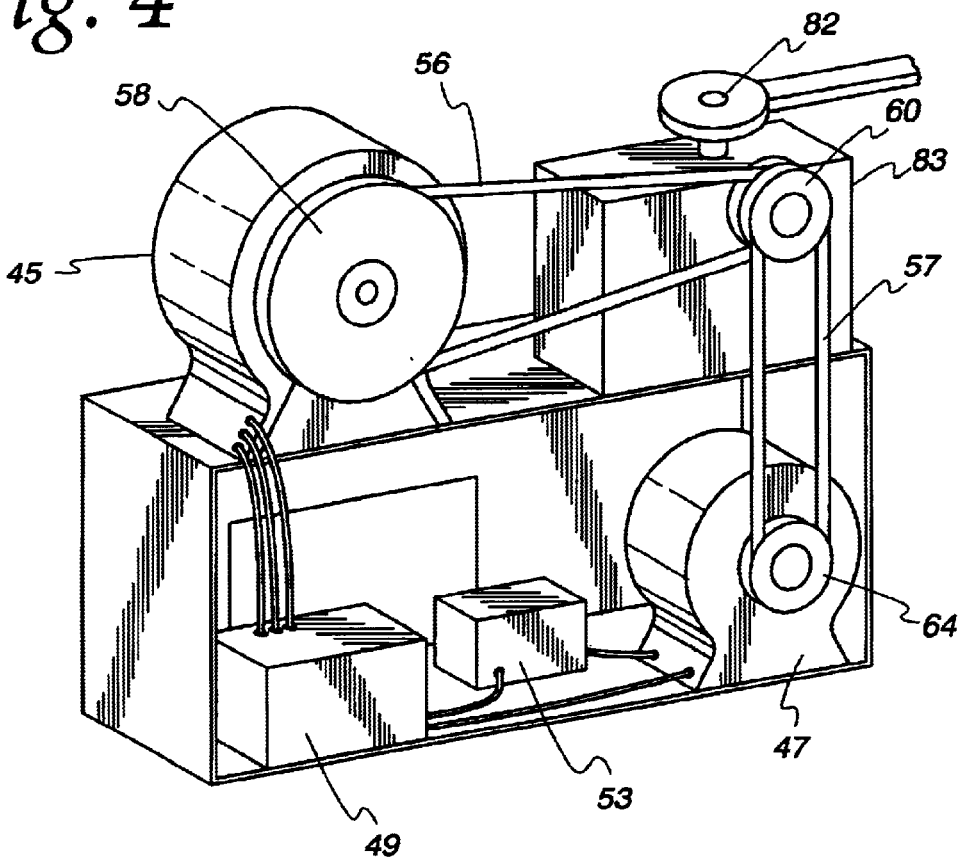
FIG. 4 is a raised perspective view of the primary and secondary power source and their connection to a portion of a swinging barrier movement mechanism.
Figure 5:
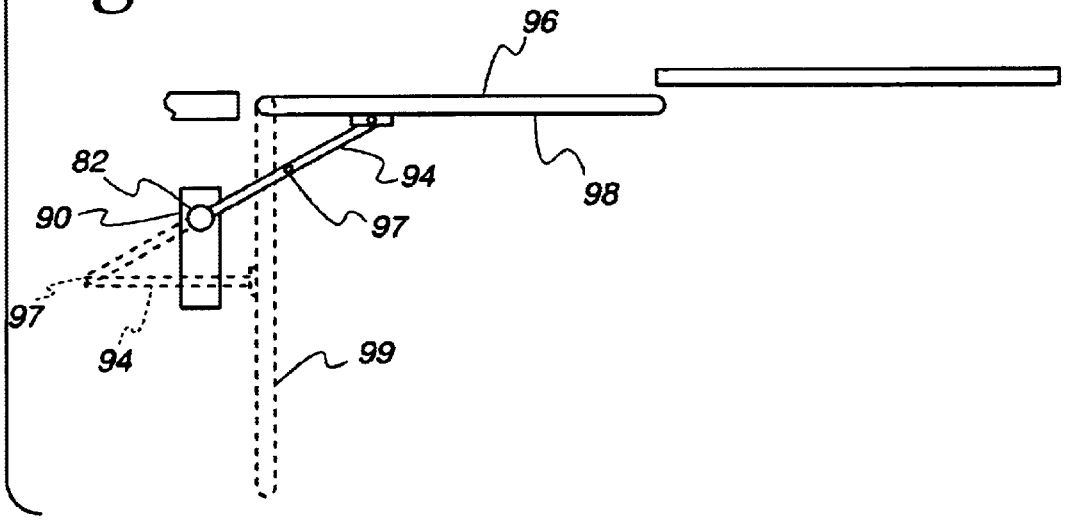
FIG. 5 is a top view of a swinging gate security system that might employee the apparatus depicted in FIG. 4.

FIG. 4 depicts a version of the present invention designed to work with a swinging gate. In FIG. 4 all of the aspects of the invention that are the same as that depicted in FIG. 2 are numbered the same and the commentary on that particular feature is the same. In fact the only substantial difference between the FIG. 2 and FIG. 4 is that gearbox 83 has a rotating cam 82 extending out of its top instead of a pulley extending from its side. Naturally, gearbox 83 has a different gearing structure located within its interior than gearbox 43. However, such gearboxes, 43 and 83, are well known in the art and need not be discussed further with respect to their interior structure for a proper understanding of how the invention works. FIG. 5 is an overhead view of a swinging security gate. The entire apparatus depicted in FIG. 4 is depicted in FIG. 5 enclosed in housing 90 with the exception of rotary cam 82 that projects out of the top of housing 90. As depicted in FIG. 5 cam 82 and its arm 94 connect to gate 96. Arm 94 has a joint 97 that allows arm 94 to bend or jackknife as cam 82 rotates and thereby by moves gate 96 from a closed position 98 to a an open position, shown in outline, 99 and then move back to the closed position 98.

Controller 49 can be programmed to periodically test the backup DC motor 47 and DC battery 53. Additionally, controller would include a DC battery charger and would monitor the charge on DC battery 53 to assure it is properly charged at all times.

Figure 6:
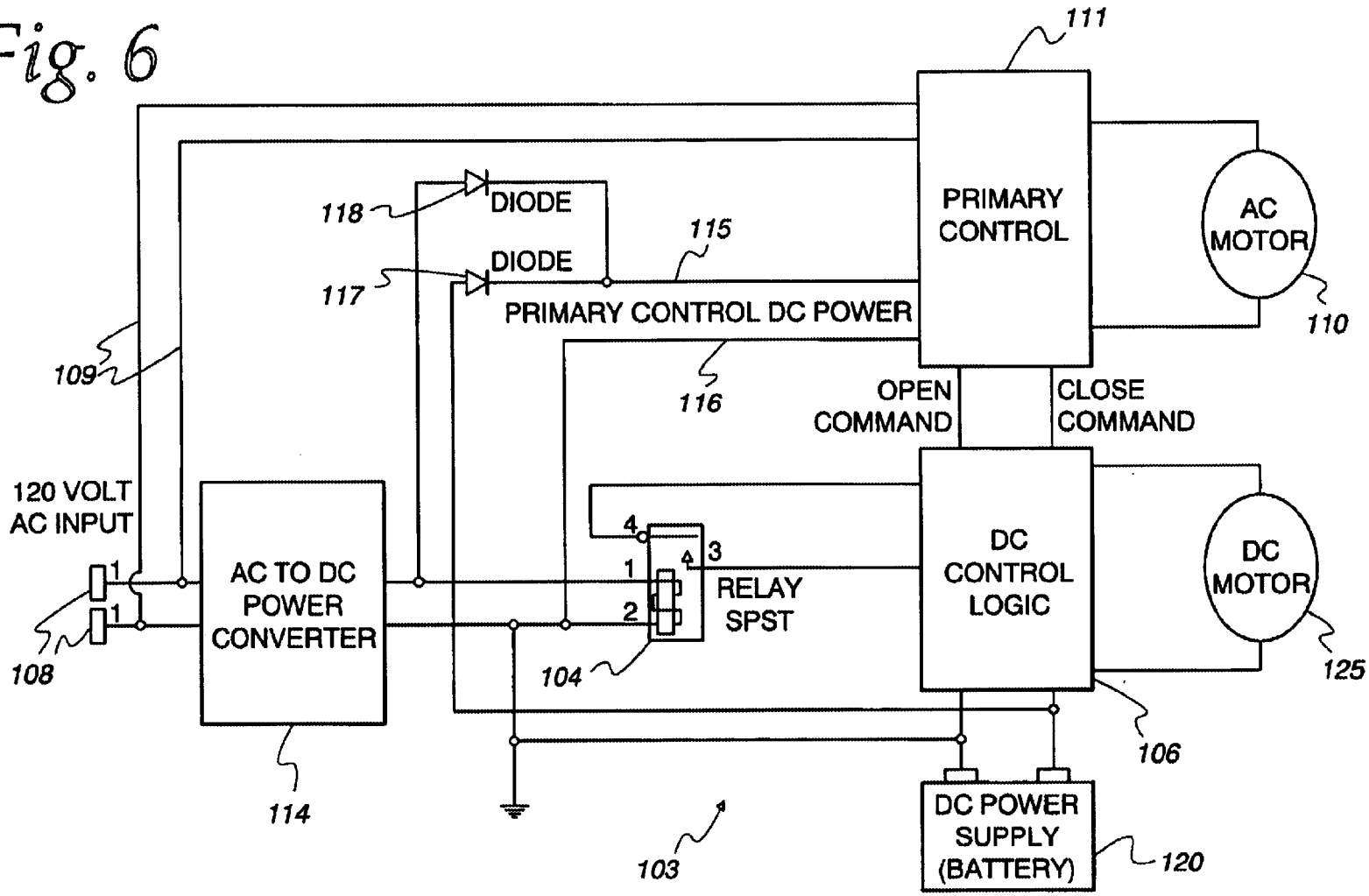
FIG. 6 is a schematic diagram of one version of a sensor/activator.

FIG. 6 provides a schematic type of block diagram of one variation of the sensor-activator of the present invention. Sensor activator 104 connects to AC-DC power converter 114. As can be seen, AC-DC power converter 114 receives power in the form of AC current from local power grid 108 and converts to DC current. AC power is provided directly over lines 109 through to the primary controller 111 to AC motor 110. The sensor-activator of the present invention is a relay type of switch 104, and it connects to DC control logic unit 106. DC control logic in turn connects to DC power supply 120 as well as to DC motor 25. DC control logic unit 106 also connects to the primary controller 111. DC power is provided to the primary control unit over lines 115 and 116. Diodes 117 and 118 limit the flow of power in one direction on the two lines to which they form a part. Relay switch 104 upon a loss of power at AC-DC power supply 114 changes state, which in turn generates a signal. The signal, generated by relay swithch 104 signals DC control logic 106 that there has been a loss of power at the AC-DC power converter 114. DC control logic 106 then immediately switches operation over to DC power 120, which provides power to all of the components. DC control logic 106 is a standard control system that will activate DC power supply 120 on receipt of the signal indicating a loss of power at AC-DC power converter.

Figure 7:
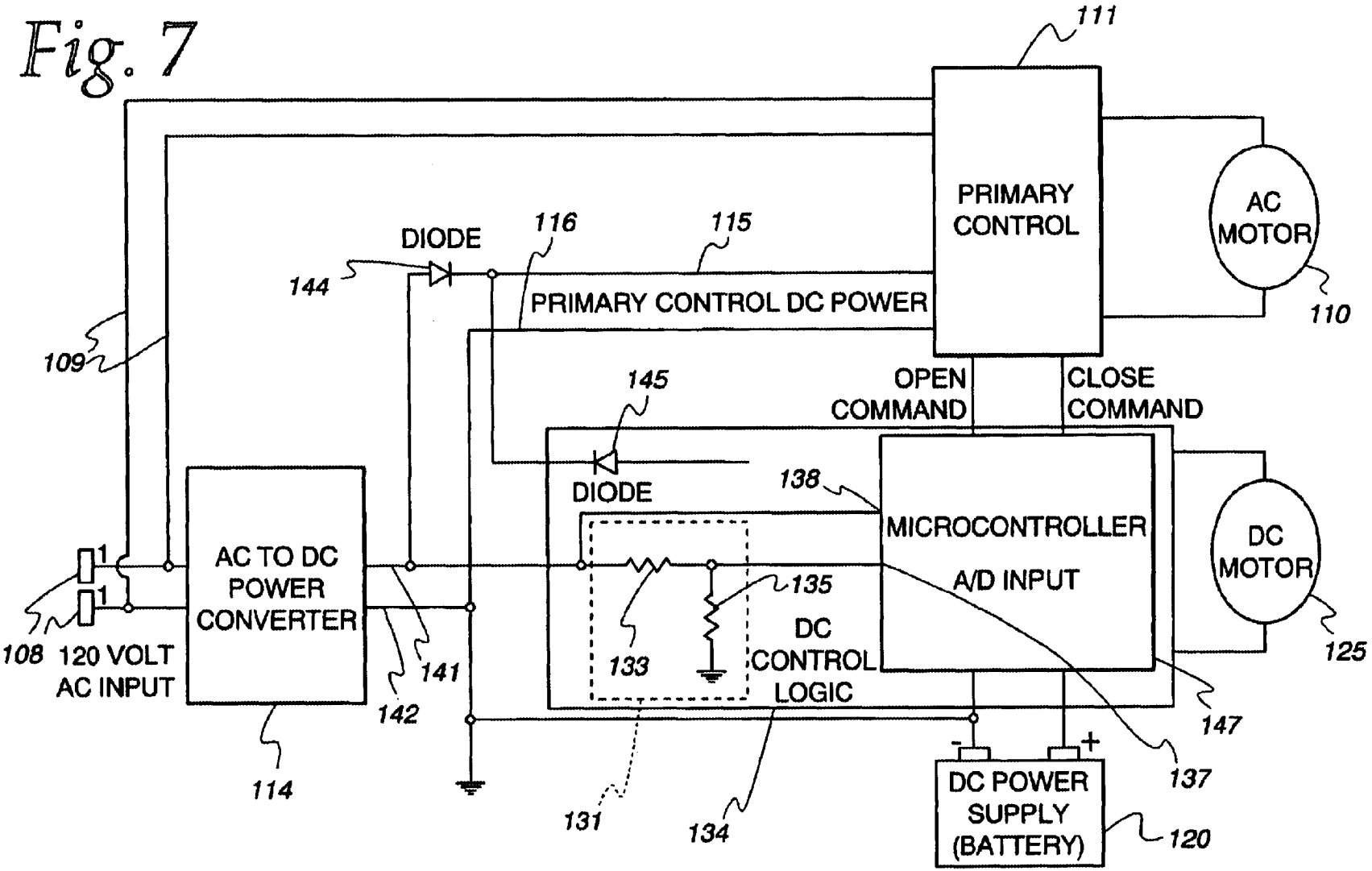
FIG. 7 is a schematic diagram of another variation of a sensor activator.

FIG. 7 provides another variation of a sensor-actuator that could be used with the present invention. In FIG. 7, the same components that appear in FIG. 6 are given the same number. The version depicted in FIG. 7 includes a micro-controller 147, appropriately programmed, resistor network 131 comprising of resistors 133, and 135 that together form the sensor actuator 134. Sensor activator 134 replaces the relay mechanism, and DC control logic of FIG. 6. Referring back to FIG. 7, when a loss of power occurs at the AC to DC converter 114, the resistor network 133 and 135 indicate a change of state that is received by micro controller 147 at inputs 138 and 137. Upon receiving indication of the change of state of resistors 133 and 135 at input points 137, and 138 Microcontroller 147, immediately switches on power from DC power supply 120, which, thereby, allows continued operation of the system with DC motor 125, and all of their components that operate under DC power. Microcontroller 147 can be any standard type of microcontroller that can be programmed to perform the appropriate switching function control use of DC power supply 120.

While the invention has been particularly shown and described with reference to a preferred embodiment thereof, it will be understood by those skilled in the art that various changes in form and detail may be made to it without departing from the spirit and scope of the invention.

We claim:

1. A security barrier system with alternate power source, said system comprising:

a security barrier movable between an open and a closed position;

a mechanical apparatus for moving said barrier when said mechanical apparatus is engaged by an appropriate motive force;

a primary motor for engaging said mechanical apparatus to thereby move said barrier between said open and closed position;

a primary power supply to power operation of said primary motor;

a barrier controller operatively connected to said primary motor to thereby control the bi-directional movement of said barrier between said open and closed position by controlling operations of said primary motor;

a secondary motor operatively connected to said barrier controller and said secondary motor engaging said mechanical apparatus;

a secondary power supply to power operation of said secondary motor;

a sensor connected to said system for sensing failure to said primary power supply or primary motor; and an activation device connected to said system, which upon receipt of a signal from said sensor indicating a failure of said primary power supply or said primary motor activates operation of said secondary power supply and said secondary motor,and said controller continues to control bi-directional movement of the barrier between said open and closed positions without interruption.

2. The system of claim 1 wherein said primary motor is an AC power supply, said secondary motor is a DC motor, said secondary power supply is a DC power supply.

3. The system of claim 2 wherein said DC power supply is a storage battery.

4. The system of claim 2 wherein during operation of said primary motor and said primary power supply, said primary power supply charges said secondary power supply.

5. The system of claim 2 wherein said barrier controller, said sensor and said activation device all function on DC power and further including a converter to convert AC power from said primary power supply to DC power to power operation of said barrier controller, said sensor and said activation device and wherein when said primary power supply fails said barrier controller, said sensor and said activation device all receive power from said DC power supply.

6. The system of claim 5 further including one or more detection devices in and around said barrier, said detection devices being operatively connected to said barrier controller which responds thereto to control opening and closing of the barrier under power of the primary motor or the secondary motor.

7. A system of claim 6 wherein the detection device comprises a safety detection device.

8. A system of claim 6 wherein the detection device comprises a loop detector.

9. A system of claim 6 wherein the detection device comprises communication apparatus for remote actuation of said barrier.

10. The system of claim 1 wherein said security barrier is at least one of a security gate, a garage door said and apartment complex door.

11. The system of claim 1 wherein said security barrier is at least one of a swinging gate, a sliding gate, an overhead gate and a barrier gate.

* * * * *